United States Patent [19]

Lucke

[11] 4,179,221

[45] Dec. 18, 1979

[54] PLOUGH-SHARE-LIKE MIXING TOOL

[75] Inventor: Roland Lucke, Paderborn-Wewer, Fed. Rep. of Germany

[73] Assignee: Gebruder Lodige Maschinenbaugesellschaft mbH, Paderborn, Fed. Rep. of Germany

[21] Appl. No.: 915,251

[22] Filed: Jun. 13, 1978

[30] Foreign Application Priority Data

Jun. 30, 1977 [DE] Fed. Rep. of Germany ..... 2729477

[51] Int. Cl.[2] ..... B01F 7/00

[52] U.S. Cl. ..... 366/309

[58] Field of Search ..... 366/69, 65, 221, 241, 366/279, 309, 312, 313, 66, 67, 343

[56] References Cited

U.S. PATENT DOCUMENTS

| | | | |
|---|---|---|---|
| 1,656,665 | 1/1928 | Dehuff | 366/279 |
| 3,215,412 | 11/1965 | Kindler | 366/65 |
| 4,070,957 | 1/1978 | Kokekawa | 366/279 |

*Primary Examiner*—Edward J. McCarthy

*Attorney, Agent, or Firm*—Thomas J. Greer, Jr.

[57] ABSTRACT

A plough-share like mixing tool for brushing the internal wall of a cylindrical mixer container is disclosed. The mixing tool is designed for attachment to the outer end of a radial arm and fixed on the shaft of a mixing mechanism rotatably mounted in the mixer.

The reverse side of the mixing tool is designed to form a convexly curved envelope.

5 Claims, 4 Drawing Figures

PLOUGH-SHARE-LIKE MIXING TOOL

BACKGROUND OF THE INVENTION

The present invention relates to a plough-share-like mixing tool for a mixing mechanism rotatably mounted in a mixer with a cylindrical mixer container, which mixing tool is arranged on the outer end of a radially running arm fixed on the shaft of the mixing mechanism and brushes the internal wall of the mixer container.

Mixing tools of this type are known, for example from German Auslegeschrift No. 1,051,250. These known plough-share-like mixing tools are designed symmetrically, i.e., have mirror image identical sides, so that they convey the mixed product which they have ploughed through fairly uniformly towards both sides. The mixing tool is generally designed as a closed hollow body and has, in particular, a closed base which revolves tight against a container wall and whose shape is adapted to the shape of the cylindrical container wall. This mixing tool should not only bring about the mixing process but also ensure that as far as is possible no mixed product is deposited on the container wall or that any deposits which may have been formed on the wall are kept as small as possible or even removed from the wall.

It is also known to use so-called half-shovels for brushing the vertical end walls of a mixer container, that is to say half a plough-share-like mixing tool halved in the length-wise direction along its mirror plane, and which therefore has only one edge for mixing and conveying the mixed product on one side, the other side being absent and, accordingly, the arm holding the mixing tool runs along the respective end wall of the mixer container, directly on the wall and keeps it free from, or removes, deposits of mixed product. If necessary, the shovel itself may be dispensed with in such a mixing tool so that an arm extending radially from the shaft of the mixing mechanism to the internal wall of the container, brushes the respective end wall of the mixing container when the shaft of the mixing mechanism runs.

In many cases, and particularly when a pressure other than atmospheric pressure is to prevail in the mixer container during operation, containers with curved ends and in particular mixer containers whose ends are formed by so-called dished boiler ends are used. Owing to the special curved shape of the dished boiler ends, tools of specific contour are necessary for brushing these internal walls. Formerly, when tools were provided mainly in the region of the dished boiler ends, they were designed simply as a type of stripper, that is to say, as tools which have almost no conveying action and only an unsatisfactory mixing action.

SUMMARY OF THE INVENTION

An object of the invention is to create a mixing tool for use in the region of a dished boiler end, which keeps the internal wall of the dished boiler and free from deposits of mixed product or removes deposits of mixed product from the internal wall of the dished boiler end as well as performing a significant mixing function.

According to the invention there is provided a plough-share-like mixing tool for a mixing mechanism rotatably mounted in a mixer with a cylindrical mixing container, which mixing tool is arranged at the outer end of a radial arm fixed to the shaft of the mixing mechanism and brushes the internal wall of the mixing container, wherein the reverse side of said mixing tool is designed to form a convexly curved envelope.

In contrast to the known plough-share-like mixing tools revolving with straight edges at the end of the mixer container, the mixing tool of the invention is not half a plough-share-like tool, having only one side and designed to convey only on one side, but is adapted to the contour of the end of the mixer container in such a way that conveyance takes place toward both sides and, in addition, the end wall of the mixer container is substantially brushed so that deposits are not formed on the wall particularly in problematical areas or if nevertheless they are formed, that they are removed from time to time.

The reverse side of the mixing tool according to a preferred embodiment of the invention is preferably designed asymmetrically. On one side, that is to say on the side projecting into the cylindrical part of the container, the mixing tool may be provided with an extension, while the other side is substantially designed as a shaver which in particular projects into markedly curved sections of the end of the container. However, if deposits are able to form on the wall in the central area of the end wall of the container, this shaver may be provided with an extension leading into this area.

This ensures brushing of all of the critical areas of the container wall in the region of the ends of the container, while the mixing tool performs mixing in the end region of the container as well as in the remainder of the container.

The mixing tool according to the invention may have either concave or convex lateral faces, that is to say the shape of the lateral faces is not decisive for the cleaning function performed on the container wall in the end region of the mixer container.

In a particularly simple preferred embodiment of the invention, the mixing tool comprises two plate-like sections which are joined together at an obtuse angle and have the corresponding curvatures and contours. The mixing tool does not therefore have a completely closed base but is formed from plate-like sections which are cut in one piece from a plate and bent into the desired opposite angular form.

The envelope formed by the underside of the mixing tool of the invention is particularly advantageously designed in such a way that it corresponds to the curvature of the internal wall of a dished boiler end. It is exactly those ends in particularly critical areas, that is to say in the areas of greatest currative which, have not been or only very imperfectly been brushed with mixing tools in the past.

BRIEF DESCRIPTION OF THE DRAWINGS

In the accompanying drawings which illustrate an embodiment of the invention.

Figure 1:
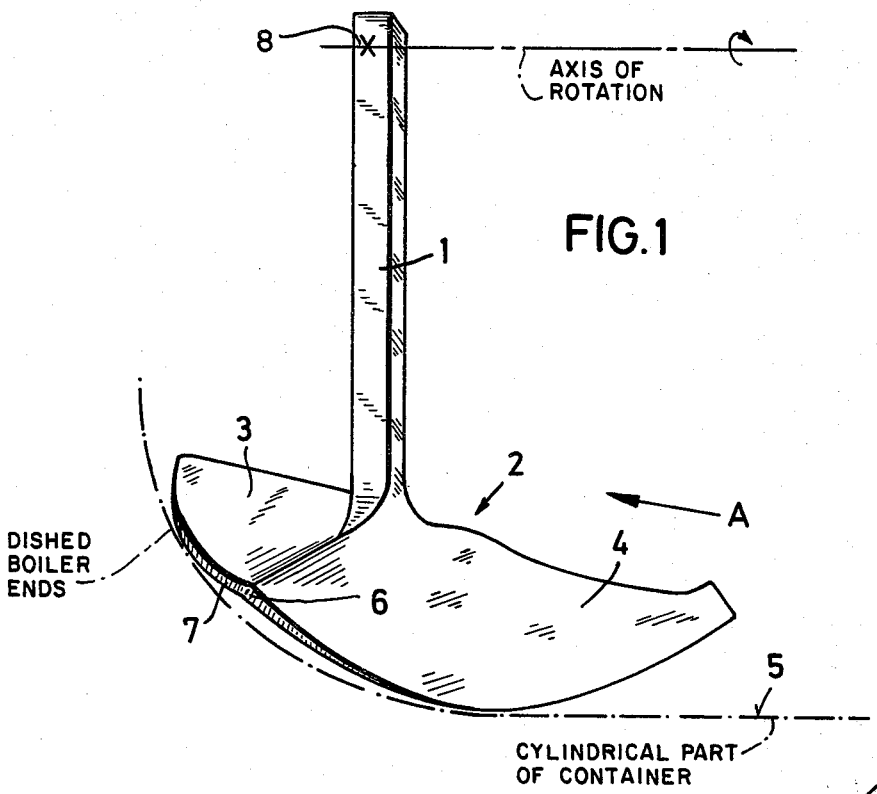
FIG. 1 shows a diagrammatrical front view of an embodiment of the mixing tool according to the invention. The contour of the internal wall of the mixer container (not shown in more detail) which is to be brushed by the tool is shown in a dash-dotted line.
Figure 2:
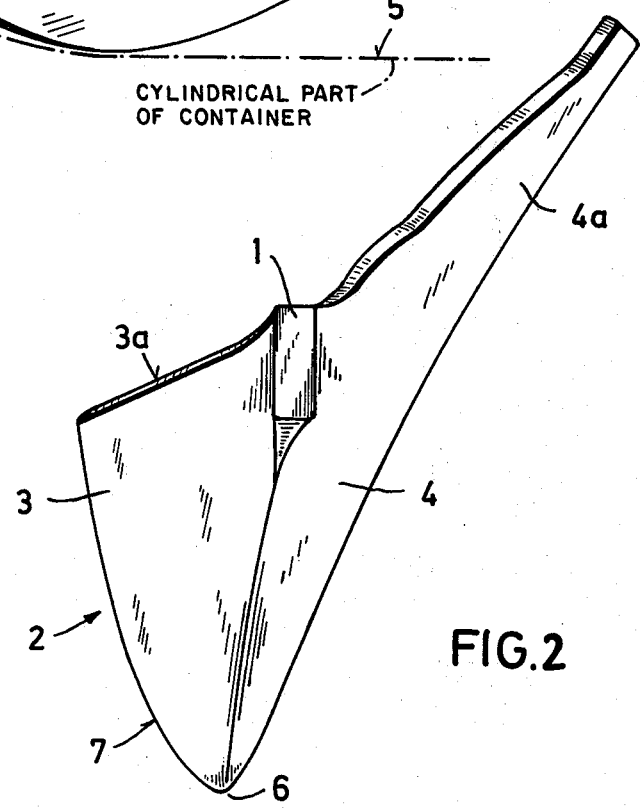
FIG. 2 is a plan view of the mixing tool of FIG. 1 slightly rotated.

This embodiment of the mixing tool according to the invention has a solid arm 1 made of square material and a shovel component 2 which is shaped from a heavy metal plate. The shovel component 2 is divided into two sections 3 and 4, these sections being, in plan view, on opposite sides of the radial arm 1, section 3 being designed to produce a shaving action and section 4 being designed as half of a known plough-share-like mixing tool. The shovel 2 is carried at the outer end of radial arm 1. Both section 3 and section 4 in the embodiment shown have top surfaces or outer faces which are curved concavely inwards but can also have surfaces which are curved convexly.

Section 3 ends at the rear end 3*a* whereas section 4 has an extension 4*a* which penetrates far into the cylindrical part of a mixing container 5 (which is merely indicated by a dash-dotted line) when the mixing tool is fixed to the shaft of the mixing mechanism (not shown) and revolves in the container 5 with the shaft.

The reverse side of the mixing tool is formed to correspond to the cylindrical contour of the container 5 and so that the point 6 is raised as illustrated in FIG. 1. The envelope curve of the reverse side formed by the shovel component 2 of the mixing tool when the mixing tool revolves is therefore cylindrical when viewed in the direction of rotation and is curved asymmetrically in the direction transverse to it, to conform to the shape of the end wall of the mixer container 5. The mixing tool shown in the drawing is intended for a mixer container whose ends are formed by so-called dished boiler ends.

The mixing tool should be detachably or permanently fixed by means of the arm 1 to a mixing mechanism shaft which is rotatably mounted coaxially in the mixer container 5. The attachment of the radial arm 1 to the mixing mechanism shaft is denoted by the numeral 8. As the mixing mechanism and, in particular, the mixing mechanism shaft do not form the subject-matter of the invention, it is not necessary to illustrate them in the drawings.

Figure 3:
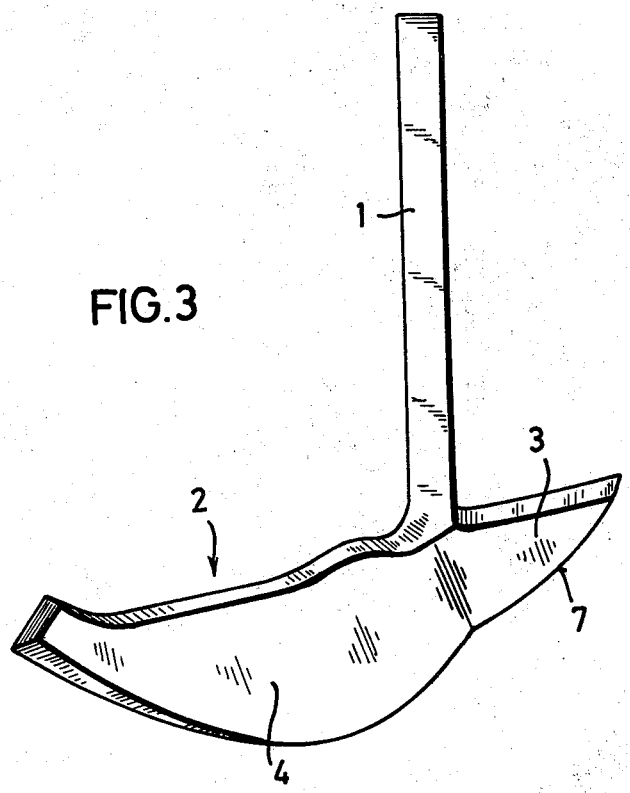
FIG. 3 is a rear view of the mixing tool of FIG. 2.
Figure 4:
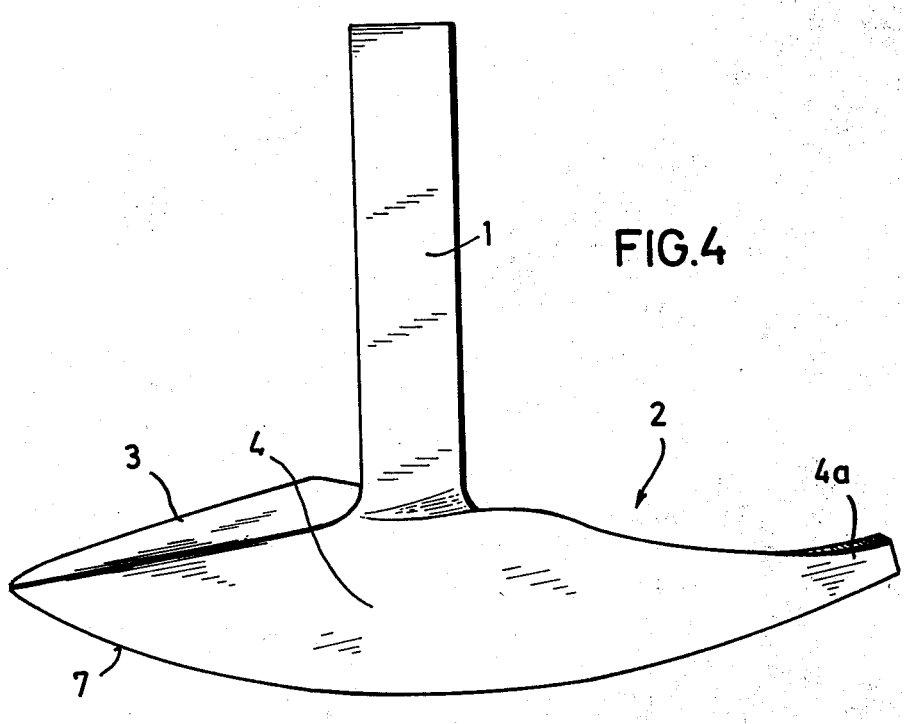
FIG. 4 is a side view of the mixing tool of FIG. 2.

As shown in particular in FIG. 4 which illustrates the mixing tool in a side view in the direction of the arrow A shown in FIG. 1, the section 3 is higher than the section 4 so that the edge 7 of the shovel component 2 at the bottom has the shape of a complex rising curve adapted to the curvature of the internal wall of the mixing container 5. This edge 7 is closest to the internal wall of the mixer container 5 while the remainder of the reverse side of the shovel component 2 is set back somewhat, although not much, as shown in particular in FIG. 3.

We claim:

1. A plough-share-like mixing tool for a mixing mechanism rotatably mounted in a mixer with a cylindrical mixing container having dished boiler ends, which mixing tool is carried at the outer end of a radial arm adapted to be mounted to the shaft of a mixing mechanism and with the radial outer surfaces thereof brushing the internal wall of the mixing container, the radially outermost portion of said mixing tool being asymmetrical and forming a convexly curved envelope corresponding to the curvature of the internal surface of the dished boiler end, one section of said mixing tool being, in plan view, disposed on one side of said radial arm and being provided with an extension to penetrate into the cylindrical part of the container, the other section of said tool being, in plan view, disposed on the opposite side of said radial arm and provided with a shaving portion to produce a shaving action on a dished boiler end.

2. A mixing tool according to claim 1, wherein said mixing tool has concave lateral faces.

3. A mixing tool according to claim 1, wherein said mixing tool has convex lateral faces.

4. A mixing tool according to claim 1, wherein said mixing tool comprises two plate-like sections which are joined together at an obtuse angle.

5. A mixing tool according to claim 1, wherein said one section of said mixing tool forms a shaver which rises towards its outside edge and the other section falls towards its outside edge, when viewed from the front of the tool.

* * * * *